US012137730B2

(12) United States Patent
Luo et al.

(10) Patent No.: US 12,137,730 B2
(45) Date of Patent: Nov. 12, 2024

(54) COOLING CIGARETTE FILTER AND SMOKING PRODUCT

(71) Applicant: CHINA TOBACCO HUNAN INDUSTRIAL CO., LTD., Hunan (CN)

(72) Inventors: Wei Luo, Hunan (CN); Kejun Zhong, Hunan (CN); Jianfu Liu, Hunan (CN); Lanying Xie, Hunan (CN); Liangsheng Qin, Hunan (CN); Wen Du, Hunan (CN); Jianhua Yi, Hunan (CN); Xinqiang Yin, Hunan (CN); Duo Ding, Hunan (CN); Jianhui Wen, Hunan (CN); Guoyong Xie, Hunan (CN)

(73) Assignee: CHINA TOBACCO HUNAN INDUSTRIAL CO., LTD., Hunan (CN)

( * ) Notice: Subject to any disclaimer, the term of this patent is extended or adjusted under 35 U.S.C. 154(b) by 625 days.

(21) Appl. No.: 17/418,219

(22) PCT Filed: Feb. 20, 2019

(86) PCT No.: PCT/CN2019/075521
§ 371 (c)(1),
(2) Date: Jun. 24, 2021

(87) PCT Pub. No.: WO2020/133647
PCT Pub. Date: Jul. 2, 2020

(65) Prior Publication Data

US 2022/0079215 A1 Mar. 17, 2022

(30) Foreign Application Priority Data

Dec. 26, 2018 (CN) ..... 201811598788.5

(51) Int. Cl.
*A24D 3/04* (2006.01)
*A24D 1/20* (2020.01)
(Continued)

(52) U.S. Cl.
CPC ..... *A24D 3/048* (2013.01); *A24D 1/20* (2020.01); *A24D 3/0275* (2013.01); *A24D 3/066* (2013.01);
(Continued)

(58) Field of Classification Search
None
See application file for complete search history.

(56) References Cited

U.S. PATENT DOCUMENTS

2018/0272260 A1 9/2018 Robertson et al.

FOREIGN PATENT DOCUMENTS

CN 1078621 A 11/1993
CN 1129089 A 8/1996
(Continued)

OTHER PUBLICATIONS

English translation of CN 108095195 (Year: 2018).*
(Continued)

*Primary Examiner* — Katherine A Will
(74) *Attorney, Agent, or Firm* — MASCHOFF BRENNAN; Ran Pang; Michael Mauriel

(57) ABSTRACT

A cooling cigarette filter and a smoking product are provided. The cooling cigarette filter comprises a cooling section. The cooling section is provided with one or more channels connecting two ends of the cooling section, and an inner surface of each channel is coated with a cooling material. The cooling material comprises an inorganic phase change material and PEG, and the inorganic phase change material comprises at least one of Na2CO3·10H2O, CH3COONa·3H2O, CaCl2·4H2O, and Na2SO4·10H2O.
(Continued)

The cooling cigarette filter has the advantages of ensuring the amount of smoke and lowering the temperature of the smoke entering the mouth, especially in the cooling section. Through the combination design of the structure of the cooling stick and the type and amount of the cooling material, the smoke can flow out of a smoke generation section rapidly and smoothly.

18 Claims, 2 Drawing Sheets

(51) Int. Cl.

| | |
|---|---|
| ***A24D 3/02*** | (2006.01) |
| ***A24D 3/06*** | (2006.01) |
| ***A24D 3/14*** | (2006.01) |
| ***A24D 3/16*** | (2006.01) |

(52) U.S. Cl.
CPC ..... *A24D 3/067* (2013.01); *A24D 3/14* (2013.01); *A24D 3/16* (2013.01)

(56) References Cited

FOREIGN PATENT DOCUMENTS

| | | | | | |
|---|---|---|---|---|---|
| CN | 104720101 | A | | 6/2015 | |
| CN | 104720112 | A | | 6/2015 | |
| CN | 106255431 | A | | 12/2016 | |
| CN | 107259639 | A | | 10/2017 | |
| CN | 108095195 | A | * | 6/2018 | ..... A24F 47/008 |
| CN | 108201169 | A | | 6/2018 | |
| CN | 108451054 | A | | 8/2018 | |
| CN | 108523216 | A | * | 9/2018 | ..... A24B 15/30 |
| CN | 108523220 | A | | 9/2018 | |
| CN | 108542001 | A | | 9/2018 | |
| CN | 108783588 | A | | 11/2018 | |
| JP | 2017518041 | A | | 7/2017 | |
| JP | 2018530318 | A | | 10/2018 | |

OTHER PUBLICATIONS

English translation of CN 108523216 (Year: 2018).*
International Search Report issued in International Application No. PCT/CN2019/075521 dated Sep. 3, 2019, 3 pages.

* cited by examiner

COOLING CIGARETTE FILTER AND SMOKING PRODUCT

CROSS REFERENCE TO RELATED APPLICATIONS

This application is a U.S. National Phase application under 35 U.S.C. § 371 of International Application No. PCT/CN2019/075521 filed on Feb. 20, 2019 which claims priority to Chinese Application No. 201811598788.5 filed on Dec. 26, 2018. The entire content of this application is hereby incorporated herein by reference.

FIELD OF THE INVENTION

The present invention relates to a cooling cigarette filter and a smoking product, and belongs to the technical field of smoking products.

BACKGROUND OF THE INVENTION

The global market of new tobacco products is growing rapidly and developing rapidly. The global sales of new tobacco products was only $1.004 billion in 2010, and increased to $17.750 billion in 2010, with an average annual increase of 50.7%. The global sales of e-cigarettes were only $1.003 billion in 2010, and increased to $11.441 billion in 2017, with an average annual increase of 41.6%. Heat-not-burn cigarettes had a stronger momentum of development, with global sales of only $6 million in 2013, increased to $6.309 billion in 2017, with an average annual increase of 469.5%. Consumer groups of the new tobacco products have become quite large. In 2017, the global consumer groups were 47 million, e-cigarette consumers exceeded 37 million, and heat-not-burn cigarette consumers were about 10 million. Philip Morris International iQOS has expanded to 43 countries around the world, with 8.8 million consumer groups.

From 2010 to 2017, the global output of traditional cigarettes fell by an average annual rate of 1.5%, which was in sharp contrast to the high-speed growth in sales of new tobacco products of 50.7%. By data analysis, the global consumer groups of new tobacco products will reach 55 million in next five years, and a considerable part of the consumer groups will be converted from traditional cigarette consumers. According to statistics from Philip Morris International, more than 67% of the iQOS consumers are converted from the traditional cigarette consumers, and most of them no longer use traditional cigarettes. The shift and differentiation of the consumer groups have intensified the market situation of "stock split" between traditional tobacco and new tobacco. According to calculations from Euromonitor International, the global sales of traditional cigarettes will continue to decline at a rate of 1-2% year by year in next five years, and the sales volume cannot be maintained by price rise. The traditional cigarettes may still grow slightly in local markets, but the growth has reached its limit around the world.

At present, the mainstream heat-not-burn cigarettes on the market include iQOS of Philip Morris and glo of British American Tobacco. After the two kinds of cigarettes reach atomization temperatures under the heating condition of 250-350° C., the temperature of high-temperature atomization smoke entering the mouth through a filter will be higher than the burning temperature of ordinary cigarettes, so that the smoke entering the mouth is too hot, and there are great differences from traditional cigarettes in terms of smoking experience, smoking experience, etc.

The existing technologies mainly cool the high-temperature smoke flowing longitudinally through phase change cooling materials, for example, the materials for cooling sections of iQOS are mainly creased, pleated, aggregated and folded polylactic acid (PLA) sheets. The lengths of cigarette filters and the phase change cooling materials are limited, and the smoke flows relatively fast, so that it is difficult to cool the materials. The lateral heat transfer of the overheated smoke passing through the cigarette filter makes a consumer feel hot when smoking. In addition, the PLA sheets of the phase change cooling materials will melt after contacting the high-temperature smoke, so that smoke channels are blocked, which affects the cooling effect of the materials and even significantly reduces the amount of smoke.

SUMMARY OF THE INVENTION

In view of the shortcomings of the existing technologies, one of the objectives of the present invention is to provide a cooling cigarette filter to significantly reduce the temperature of high-temperature smoke entering the mouth and improve the smoking experience; and the second objective of the present invention is to provide a smoking product.

In order to solve the above technical problems, the technical solution of the present invention is as follows:

A cooling cigarette filter includes a cooling section, the cooling section is provided with one or more channels connecting two ends of the cooling section, and an inner surface of each channel is coated with a cooling material; the cooling material includes an inorganic phase change material, and the inorganic phase change material includes at least one of $Na_2CO_3 \cdot 10H_2O$, $CH_3COONa \cdot 3H_2O$, $CaCl_2 \cdot 4H_2O$, and $Na_2SO_4 \cdot 10H_2O$. By such a structural design, smoke to be cooled enters the cooling section and then fully contacts the cooling material to exchange heat, and the heat of the smoke is transferred to the cooling material, so that the temperature of the smoke is lowered. In addition, the cooling section is provided with the channel connecting its two ends, so the suction resistance is small, the smoke can pass easily, and the absorption of the smoke by the cooling cigarette filter is significantly reduced. The coating amount of the cooling material can be selected according to the cooling needs, taking into account the cooling effect, the effect of smoke adsorption, the cost, etc. The inorganic phase change materials are all phase change materials, with the abilities of cooling and water absorption. When the smoke passes through the cooling section, it fully contacts the cooling material, which can further enhance the cooling effect and adsorb the hot water vapor in the smoke.

Further, the cooling material further includes PEG. Accordingly, the PEG is compounded with the inorganic phase change material to form the cooling material, which gives full play to their respective advantages and achieves a good cooling effect. Further, the PEG includes at least one of PEG-200, PEG-400, PEG-600, PEG-800, PEG-1000, PEG-1500, PEG-2000, PEG-4000, PEG-6000, PEG-8000, PEG-10000, and PEG-20000.

Further, the PEG is at least one of PEG-200, PEG-400, PEG-600, PEG-800, PEG-1000, PEG-1500, PEG-2000, PEG-4000, PEG-6000, and PEG-8000. The PEG is a low molecular weight PEG or a medium molecular weight PEG, which can be better dissolved in anhydrous ethanol, so that the production process such as coating is easy to carry out. The high molecular weight PEG such as PEG-10000 and PEG-20000 can be dissolved by anhydrous ethanol heated to about 60-70° C., and has a lower solubility than that of the low molecular weight PEG and the medium molecular weight PEG, which easily leads to inconvenience of coating operation, large waste of ethanol solvent, and inconvenience to production. The applicant further discovered through research that when the high molecular weight PEG is used, the raw materials such as PEG are easily adhered to the production equipment, which affects the normal operation of the equipment and increases the labor cost for equipment cleaning. Therefore, the low molecular weight PEG and the medium molecular weight PEG can better meet the needs, and are beneficial to obtaining higher cost performance.

Further, the mass ratio of the inorganic phase change material to the PEG in the cooling material is (1-2):(1-5), further (1-2):(1-3), and optionally 1:1, 2:1, 1:5, or 2:5. By selecting the type of PEG and controlling its content, the PEG itself can achieve a phase change cooling effect, and can be used as a good binder, e.g., PEG-1000, PEG-1500, PEG-2000, PEG-4000, etc., to adhere the inorganic phase change material to the inner surfaces of the channels more stably, so as to fully exert the effect of the inorganic phase change material.

Further, the coating amount of the cooling material is 3-50 $g/m^2$ (dry weight), further 5-30 $g/m^2$, and preferably 15-30 $g/m^2$.

After repeated experiments by the applicant, it is found that when the cooling material is composed of one or more of inorganic hydrated salt phase change materials, the coating amount needs to reach 5 $g/m^2$ to achieve the cooling effect, but when the compound mixture of the inorganic hydrated salt phase change material and the PEG is used for coating, the coating amount of the compound mixture only needs to reach 3 $g/m^2$ to achieve the similar effect, its smoke temperature is equivalent to the smoke temperature of iQOS, and the total particulate matter of the smoke reaches about 80% of the total particulate matter in the iQOS smoke.

Further, when the coating amount of the compound mixture of the inorganic hydrated salt phase change material and the PEG is 5 $g/m^2$, the mixture can achieve a better cooling effect, its smoke temperature is further reduced by 6-7° C. compared to the smoke temperature of iQOS, the total particulate matter of the smoke can reach about 90% of the total particulate matter of the iQOS smoke, and the effect of cooling and low smoke entrapping is achieved.

In addition, compared with the patents CN2018109704836 and CN2018115312894 previously applied by the applicant, this application has obvious advantages in terms of the amount of cooling material and cooling effect, especially when the cooling material contains both the inorganic phase change material and the PEG, the advantages of this application are more obvious. For example, when the compound mixture of $CH_3COONa \cdot 3H_2O$ and PEG is used as the cooling material in this application and the coating amount is 5 $g/m^2$, the temperature of smoke entering the mouth can be reduced by 9-10° C. relative to that of iQOS. When PEG is used alone as the cooling material and the coating amount is 5 $g/m^2$, the temperature of smoke entering the mouth is 6-7° C. higher than that of iQOS.

Optionally, the channel is a through hole or an irregular hole.

Optionally, the cross section of the channel is circular or polygonal.

Optionally, the cross section of the channel is irregular.

Further, the number of the channels is plural.

In some embodiments of the present invention, the cooling section is formed by repeatedly bending or twisting a carrier in a cylindrical space, and the cooling material is coated on the surface of the carrier; the carrier is one of paper, an organic polymer film, and a non-woven fabric. Further, the carrier is preferably paper. Further, the paper is rectangular when unfolded, which facilitates molding, and can also ensure that the cross-sectional area of the channel of each part in the length direction of the cooling section is substantially the same after molding. Further, the basis weight of the carrier is 40-150 $g/m^2$. Further, the total specific surface area of the one or more channels is 10% to 60% of the surface area of the carrier.

The addition of the medium molecular weight PEG such as PEG1000, PEG-1500, PEG-2000 or PEG-4000 can reduce the amount of the inorganic phase change material to a certain extent, and can adhere the inorganic phase change material (generally fine particulate matters) to the carrier stably, thereby effectively preventing the inorganic phase change material from falling off the carrier during the repeated bending or twisting process of the carrier, ensuring that the cooling material of a preset quality is loaded in the cooling section, and reducing the production difficulty of the cooling cigarette filter.

Further, one or both surfaces of the paper have multiple concave-convex lines, preferably folded lines. In this way, it can be ensured that the two ends of each channel are always connected, and the smoke flows through each channel, which can reduce the suction resistance, fully exert the cooling effect of the cooling material, and reduce the adsorption of particulate matters in the smoke by the paper stick.

Further, the paper is one of cellulose paper, coated paper, wrap paper, butter paper and white cardboard, and preferably, the basis weight of the paper is 40-150 $g/m^2$. These types of paper have low smoke absorption capacity, can reduce smoke loss and improve the smoking experience, and are especially suitable for heat-not-burn cigarettes.

Further, one or both sides of the paper are coated with the cooling material.

In some embodiments of the present invention, the cooling section is formed by repeatedly bending the paper in a certain direction.

In some embodiments of the present invention, the cooling section is formed by irregularly and repeatedly bending the paper, and the bending direction of the paper is irregular when viewed from the cross section.

In the above embodiments, compared with the existing cooling cigarette filter, the carrier of the present invention is preferably paper, and due to poor thermal conductivity of the paper, the heat absorbed by the cooling material is not easily transferred to the suction end fast, which can prevent burning the smoker; on the other hand, for a heat-not-burn cigarette, not matter whether it is central heating or surrounding heating, a large amount of water vapor will be generated during the first three puffs, and the high-temperature water vapor entering the mouth will condense and release a lot of heat, so that the hot feeling of the mouth (especially the tongue) is obviously enhanced, while the paper cooling stick of the present invention has good water vapor adsorption capacity, and can effectively absorb water vapor, enhance the taste of the first three puffs and improve the smoking experience; and on another hand, after the cooling material is coated on the paper, the adsorption of particulate matters such as tar by the corresponding part of the paper can be reduced, so the cooling and low smoke entrapping cigarette filter of the present invention adsorbs a very small amount of particulate matters in the smoke, which is beneficial to improving the smoking experience.

In some embodiments of the present invention, the cooling section is formed by bundling a plurality of cylinders, and the cooling material is coated on an inner surface and/or an outer surface of the cylinder. Optionally, the cylinder is made of a paper material or an organic polymer material.

Further, a filter section is connected to one end of the cooling section.

The filter section is preferably a cellulose acetate filter stick, and further preferably a special cellulose acetate filter stick with low smoke entrapping function.

Further, the filter section has a length of 5 to 10 mm, preferably 6 to 9 mm; and further, the cooling section has a length of 12 to 50 mm, preferably 15 to 40 mm.

Further, the cooling section is wrapped with wrap paper.

Further, the cooling cigarette filter is a round stick, and further, has a perimeter of 17 to 24.2 mm.

The cooling cigarette filter of the present invention is especially suitable for heat-not-burn cigarettes. Generally, for central heating type heat-not-burn cigarettes and surrounding type heat-not-burn cigarettes, the smoke temperature of the first three puffs is relatively high, reaching 60° C. or even more than 65° C. The cooling cigarette filter of the present invention can well meet their cooling needs, and can lower the temperature of smoke entering the mouth to about 42° C. to improve the smoking experience.

A smoking product includes the above-mentioned cooling cigarette filter and a smoke generation section connected with the cooling cigarette filter. Further, the smoke generation section has a length of 10 to 60 mm, generally 10 to 50 mm, preferably 10 to 15 mm, and further preferably 11 to 13 mm.

Further, the smoke generation section is a tobacco strip composed of processed tobacco shreds or slices arranged in disorder or order.

An application of the inorganic phase change material in the cooling cigarette filter, wherein the inorganic phase change material includes at least one of $Na_2CO_3.10H_2O$, $CH_3COONa{\cdot}3H_2O$, $CaCl_2{\cdot}4H_2O$, and $Na_2SO_4{\cdot}10H_2O$.

Because the cooling section of the present invention has the characteristic of high temperature resistance (about 320° C.), the cooling section can be directly connected with the smoke generation section when the cigarette is designed, and the cooling section will not melt and burn, and still maintains its original shape, so the cigarette designed can be simplified into a three-section structure. The existing iQOS cigarette is designed into a four-section structure, in which a high-temperature resistant diversion section is arranged between the smoke generation section and the cooling section, the temperature of smoke at the contact position between the smoke generation section and the diversion section can reach about 200° C., while the polylactic acid cooling section has poor high-temperature resistance (melting point of 155-185° C.), and will completely melt when directly connected to the smoke generation section, which cannot achieve the cooling effect.

In the present invention, the inorganic phase change materials such as $Na_2CO_3{\cdot}10H_2O$, $CH_3COONa{\cdot}3H_2O$, $CaCl_2{\cdot}4H_2O$, and $Na_2SO_4{\cdot}10H_2O$ have large phase change enthalpies and strong phase change cooling abilities. When contacting the high-temperature smoke of about 200° C. at the smoke generation section, the inorganic phase change material can absorb the heat of the smoke to realize phase change cooling of the smoke. The phase change material is coated on the paper, so the phenomenon that the smoke channel is blocked caused by melting of the phase change material will not occur, and good smoking experience is guaranteed.

The cooling cigarette filter of the present invention has the advantages of ensuring the amount of smoke and lowering the temperature of the smoke entering the mouth, especially in the cooling section, through the combination design of the structure of the cooling stick and the type and amount of the cooling material, the smoke can flow out of the smoke generation section rapidly and smoothly, the temperature of the high-temperature smoke before entering the mouth can be significantly lowered, the amount of smoke is sufficient and the temperature is appropriate, thereby improving the comfort and satisfaction of smoking, and solving the problems of excessive water vapor, small amount of smoke and bad taste during the first three puffs of the existing heat-not-burn cigarettes.

DETAILED DESCRIPTION OF EMBODIMENTS

The present invention will be described in detail below with reference to the accompanying drawings and in combination with embodiments. It should be noted that the embodiments in the present invention and the features in the embodiments can be combined with each other without conflicts. For ease of narrative, the terms "upper", "lower", "left" and "right" described below are only consistent with the upper, lower, left and right directions of the drawings, and do not limit the structure.

Embodiment 1

Figure 1:
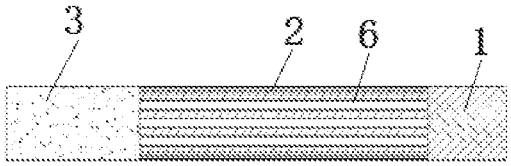
FIG. 1 is a schematic structural diagram of a cigarette according to the present invention.
Figure 2:
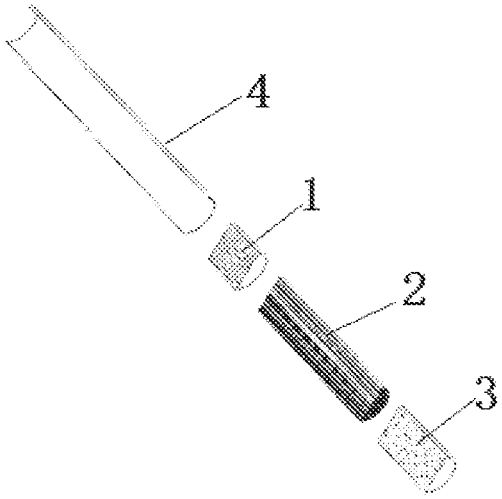
FIG. 2 is a three-dimensional sectional view (exploded view) of the cigarette according to the present invention.
Figure 3:
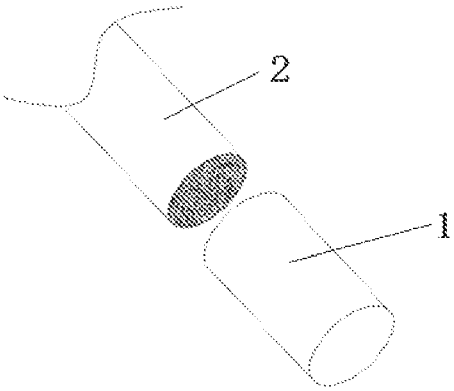
FIG. 3 is a partial enlarged three-dimensional view of a cooling stick and a smoke generation section in FIG. 1.
Figure 4:
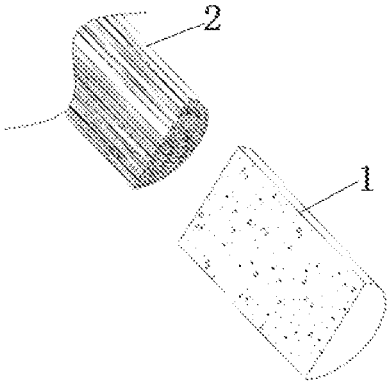
FIG. 4 is a partial enlarged three-dimensional sectional view of the cooling stick and the smoke generation section in FIG. 1.

As shown in FIG. 1, the smoking product in this embodiment is a heat-not-burn cigarette, including a filter section 1, a cooling section 2 and a smoke generation section 3 connected in sequence. The filter section is composed of a special cellulose acetate filter stick with cooling and low smoke entrapping functions, the cooling section is formed by wrapping a cooling stick with wrap paper 4, and the cooling stick is mainly formed by paper coated with a phase change cooling material.

The cooling stick has a plurality of channels 6 connecting two ends of the cooling stick, and the total specific surface area of the plurality of channels is 20% to 30% of the surface area of the cooling paper.

The paper is cellulose paper with strong moisture absorption capacity but weak tar absorption capacity. The basis weight of the paper is 80 $g/m^2$.

The cooling material is $CH_3COONa{\cdot}3H_2O$. The coating amount of the cooling material is 5 $g/m^2$.

After smoke enters the cooling section, it is in full contact with the phase change cooling material, which improves the cooling effect of the smoke, and also facilitates the rapid and smooth passing of the smoke generated in the cigarette.

The filter section has a length of 7 mm, the cooling section has a length of 26 mm, and the smoke generation section has a length of 12 mm.

Through comparative studies, it is found that when the cooling section designed in the present invention is used to replace a creased PLA film cooling section in an iQOS cigarette for smoking test, and a thermocouple is used to monitor the temperature, the maximum temperature of smoke entering the mouth is 60° C., which is 1° C. lower than the temperature of iQOS smoke entering the mouth; meanwhile, the total particulate matter in the smoke is 12.0 mg/cig, which is 3.0 mg/cig lower than that of the iQOS smoke; the amount of smoke entering the mouth is increased to a certain extent, and the cooling and low smoke entrapping effects are substantially achieved (see Table 1).

Embodiment 2

Embodiment 1 is repeated, and only the coating amount of the cooling material is increased to 10 g/m$^2$. Through comparative studies, it is found that when the cooling section designed in the present invention is used to replace a creased PLA film cooling section in an iQOS cigarette, the maximum temperature of smoke entering the mouth is 50° C., which is 11° C. lower than the temperature of iQOS smoke entering the mouth; meanwhile, the total particulate matter in the smoke is 14.5 mg/cig, which is only 0.5 mg/cig lower than that of the iQOS smoke; the amount of smoke entering the mouth is increased to a certain extent, and the cooling and low smoke entrapping effects are substantially achieved (see Table 1).

Embodiment 3

Embodiment 1 is repeated, and only the coating amount of the cooling material is increased to 20 g/m$^2$. Through comparative studies, it is found that when the cooling section designed in the present invention is used to replace a creased PLA film cooling section in an iQOS cigarette, the maximum temperature of smoke entering the mouth is 43° C., which is 18° C. lower than the temperature of iQOS smoke entering the mouth; meanwhile, the total particulate matter in the smoke is 15.2 mg/cig, which is 0.2 mg/cig higher than that of the iQOS smoke; and the cooling and low smoke entrapping effects are achieved. The smoking sensory quality of the smoke is significantly improved (see Table 1).

Embodiment 4

Embodiment 1 is repeated, only the cooling material is changed to $Na_2CO_3 \cdot 10H_2O$, and the coating amount of the phase change material is increased to 20 g/m$^2$. Through comparative studies, it is found that when the cooling section designed in the present invention is used to replace a creased PLA film cooling section in an iQOS cigarette, the maximum temperature of smoke entering the mouth is 48° C., which is 13° C. lower than the temperature of iQOS smoke entering the mouth; meanwhile, the total particulate matter in the smoke is 14.4 mg/cig, which is 0.6 mg/cig lower than that of the iQOS smoke; and the cooling and low smoke entrapping effects are achieved. The smoking sensory quality of the smoke is significantly improved (see Table 1).

Embodiment 5

Embodiment 1 is repeated, only the cooling material is changed to $CaCl_2 \cdot 4H_2O$, and the coating amount of the phase change material is increased to 20 g/m$^2$. Through comparative studies, it is found that when the cooling section designed in the present invention is used to replace a creased PLA film cooling section in an iQOS cigarette, the maximum temperature of smoke entering the mouth is 49° C., which is 12° C. lower than the temperature of iQOS smoke entering the mouth; meanwhile, the total particulate matter in the smoke is 14.5 mg/cig, which is 0.5 mg/cig lower than that of the iQOS smoke; and the cooling and low smoke entrapping effects are achieved. The smoking sensory quality of the smoke is significantly improved (see Table 1).

Embodiment 6

Embodiment 1 is repeated, only the cooling material is changed to $Na_2SO_4 \cdot 10H_2O$, and the coating amount of the phase change material is increased to 20 g/m$^2$. Through comparative studies, it is found that when the cooling section designed in the present invention is used to replace a creased PLA film cooling section in an iQOS cigarette, the maximum temperature of smoke entering the mouth is 50° C., which is 11° C. lower than the temperature of iQOS smoke entering the mouth; meanwhile, the total particulate matter in the smoke is 14.3 mg/cig, which is 0.7 mg/cig lower than that of the iQOS smoke; and the cooling and low smoke entrapping effects are achieved. The smoking sensory quality of the smoke is significantly improved (see Table 1).

Embodiment 7

Embodiment 1 is repeated, the cooling material is changed to a compound mixture of $CaCl_2 \cdot 4H_2O$ and $Na_2SO_4 \cdot 10H_2O$, the weight ratio of the two is 2:1, and the coating amount of the cooling material is 25 g/m$^2$. Through comparative studies, it is found that when the cooling section designed in the present invention is used to replace a creased PLA film cooling section in an iQOS cigarette, the maximum temperature of smoke entering the mouth is 45° C., which is 16° C. lower than the temperature of iQOS smoke entering the mouth; meanwhile, the total particulate matter in the smoke is 14.6 mg/cig, which is 0.4 mg/cig lower than that of the iQOS smoke; and the cooling and low smoke entrapping effects are achieved. The smoking sensory quality of the smoke is significantly improved (see Table 1).

Embodiment 8

Embodiment 1 is repeated, the cooling material is changed to a compound mixture of $CH_3COONa \cdot 3H_2O$ and PEG4000, the weight ratio of the two is 1:1, and the coating amount of the cooling material is 3 g/m$^2$. Through comparative studies, it is found that when the cooling section designed in the present invention is used to replace a creased PLA film cooling section in an iQOS cigarette, the maximum temperature of smoke entering the mouth is 59° C., which is 2° C. lower than the temperature of iQOS smoke entering the mouth; meanwhile, the total particulate matter in the smoke is 12.2 mg/cig, which is 2.8 mg/cig lower than that of the iQOS smoke; the amount of smoke entering the mouth is increased to a certain extent, and the cooling and low smoke entrapping effects are substantially achieved (see Table 1).

Embodiment 9

Embodiment 1 is repeated, the cooling material is changed to a compound mixture of $CH_3COONa \cdot 3H_2O$, PEG600 and PEG4000, the weight ratio of the three is 1:2:2, and the coating amount of the cooling material is 5 g/m$^2$. Through comparative studies, it is found that when the cooling section designed in the present invention is used to replace a creased PLA film cooling section in an iQOS cigarette, the maximum temperature of smoke entering the mouth is 51° C., which is 10° C. lower than the temperature of iQOS smoke entering the mouth; meanwhile, the total particulate matter in the smoke is 14.5 mg/cig, which is 0.5 mg/cig lower than that of the iQOS smoke; and the cooling and low smoke entrapping effects are achieved. The smoking sensory quality of the smoke is significantly improved (see Table 1).

Embodiment 10

Embodiment 1 is repeated, the cooling material is changed to a compound mixture of $CH_3COONa \cdot 3H_2O$ and PEG2000, the weight ratio of the two is 1:1, and the coating amount of the cooling material is 5 g/m$^2$. Through comparative studies, it is found that when the cooling section designed in the present invention is used to replace a creased PLA film cooling section in an iQOS cigarette, the maximum temperature of smoke entering the mouth is 53° C., which is 8° C. lower than the temperature of iQOS smoke entering the mouth; meanwhile, the total particulate matter in the smoke is 14.2 mg/cig, which is 0.8 mg/cig lower than that of the iQOS smoke; and the cooling and low smoke entrapping effects are achieved. The smoking sensory quality of the smoke is significantly improved (see Table 1).

Embodiment 11

Embodiment 1 is repeated, the cooling material is changed to a compound mixture of $CH_3COONa \cdot 3H_2O$ and PEG2000, the weight ratio of the two is 1:1, and the coating amount of the cooling material is 20 g/m$^2$. Through comparative studies, it is found that when the cooling section designed in the present invention is used to replace a creased PLA film cooling section in an iQOS cigarette, the maximum temperature of smoke entering the mouth is 41° C., which is 20° C. lower than the temperature of iQOS smoke entering the mouth; meanwhile, the total particulate matter in the smoke is 15.3 mg/cig, which is 0.3 mg/cig higher than that of the iQOS smoke; and the cooling and low smoke entrapping effects are achieved. The smoking sensory quality of the smoke is significantly improved (see Table 1).

Embodiment 12

Embodiment 1 is repeated, the cooling material is changed to a compound mixture of $CaCl_2 \cdot 4H_2O$ and PEG2000, the weight ratio of the two is 1:1, and the coating amount of the cooling material is 20 g/m$^2$. Through comparative studies, it is found that when the cooling section designed in the present invention is used to replace a creased PLA film cooling section in an iQOS cigarette, the maximum temperature of smoke entering the mouth is 45° C., which is 16° C. lower than the temperature of iQOS smoke entering the mouth; meanwhile, the total particulate matter in the smoke is 15.1 mg/cig, which is 0.1 mg/cig higher than that of the iQOS smoke; and the cooling and low smoke entrapping effects are achieved. The smoking sensory quality of the smoke is significantly improved (see Table 1).

Embodiment 13

Embodiment 1 is repeated, the cooling material is changed to a compound mixture of $Na_2SO_4 \cdot 10H_2O$ and PEG2000, the weight ratio of the two is 1:1, and the coating amount of the cooling material is 20 g/m$^2$. Through comparative studies, it is found that when the cooling section designed in the present invention is used to replace a creased PLA film cooling section in an iQOS cigarette, the maximum temperature of smoke entering the mouth is 46° C., which is 15° C. lower than the temperature of iQOS smoke entering the mouth; meanwhile, the total particulate matter in the smoke is 14.8 mg/cig, which is 0.2 mg/cig lower than that of the iQOS smoke; and the cooling and low smoke entrapping effects are achieved. The smoking sensory quality of the smoke is significantly improved (see Table 1).

Embodiment 14

Embodiment 1 is repeated, the cooling material is changed to a compound mixture of $CH_3COONa \cdot 3H_2O$ and PEG6000, the weight ratio of the two is 2:1, and the coating amount of the cooling material is 25 g/m$^2$. Through comparative studies, it is found that when the cooling section designed in the present invention is used to replace a creased PLA film cooling section in an iQOS cigarette, the maximum temperature of smoke entering the mouth is 40° C., which is 21° C. lower than the temperature of iQOS smoke entering the mouth; meanwhile, the total particulate matter in the smoke is 15.1 mg/cig, which is 0.1 mg/cig higher than that of the iQOS smoke; and the cooling and low smoke entrapping effects are achieved. The smoking sensory quality of the smoke is significantly improved (see Table 1).

Embodiment 15

Embodiment 1 is repeated, the cooling material is changed to a compound mixture of $Na_2CO_3 \cdot 10H_2O$, PEG1000 and PEG8000, the weight ratio of the three is 2:2:1, and the coating amount of the cooling material is 20 g/m$^2$. Through comparative studies, it is found that when the cooling section designed in the present invention is used to replace a creased PLA film cooling section in an iQOS cigarette, the maximum temperature of smoke entering the mouth is 45° C., which is 16° C. lower than the temperature of iQOS smoke entering the mouth; meanwhile, the total particulate matter in the smoke is 14.7 mg/cig, which is 0.3 mg/cig lower than that of the iQOS smoke; and the cooling and low smoke entrapping effects are achieved. The smoking sensory quality of the smoke is significantly improved (see Table 1).

Embodiment 16

Embodiment 1 is repeated, the cooling material is changed to a compound mixture of $CaCl_2 \cdot 4H_2O$ and PEG6000, the weight ratio of the two is 1:1, and the coating amount of the cooling material is 40 g/m$^2$. Through comparative studies, it is found that when the cooling section designed in the present invention is used to replace a creased PLA film cooling section in an iQOS cigarette, the maximum temperature of smoke entering the mouth is 44° C., which is 17° C. lower than the temperature of iQOS smoke entering the mouth; meanwhile, the total particulate matter in the smoke is 15.2 mg/cig, which is 0.2 mg/cig higher than that of the iQOS smoke; and the cooling and low smoke entrapping effects are achieved. The smoking sensory quality of the smoke is significantly improved (see Table 1).

Embodiment 17

Figure 5:
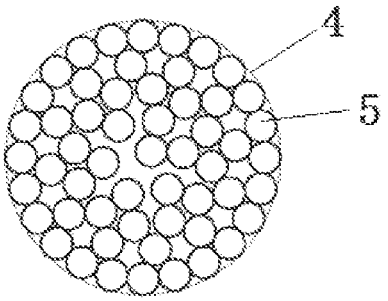
FIG. 5 is a schematic structural diagram (cross-sectional view) of a cooling section in Embodiment 17 of the present invention.

Embodiment 11 is repeated, only the cooling section is changed to be formed by wrapping a plurality of hollow cylindrical sticks 5 with wrap paper 4, surfaces of the cylindrical sticks are coated with the cooling material, the cylindrical stick has an outer diameter of 0.4 mm, and the smoke channels are mainly composed of through holes in the cylindrical sticks and gaps between the cylindrical sticks (see FIG. 5). Through comparative studies, it is found that when the cooling section designed in the present invention is used to replace a creased PLA film cooling section in an iQOS cigarette, the maximum temperature of smoke entering the mouth is 37° C., which is 24° C. lower than the temperature of iQOS smoke entering the mouth; meanwhile, the total particulate matter in the smoke is 15.8 mg/cig, which is 0.8 mg/cig higher than that of the iQOS smoke; and the cooling and low smoke entrapping effects are achieved. The smoking sensory quality of the smoke is significantly improved (see Table 1).

Comparative Example 1

Embodiment 1 is repeated, and only the coating amount of the cooling material is decreased to 4 g/m$^2$. Through comparative studies, it is found that when the cooling section designed in the present invention is used to replace a creased PLA film cooling section in an iQOS cigarette, the maximum temperature of smoke entering the mouth is 64° C., which is 3° C. higher than the temperature of iQOS smoke entering the mouth; meanwhile, the total particulate matter in the smoke is reduced to 8.2 mg/cig, which is 6.8 mg/cig lower than that of the iQOS smoke; the amount of smoke entering the mouth is obviously decreased, and the cooling and low smoke entrapping effects cannot be achieved (see Table 1).

Comparative Example 2

Embodiment 1 is repeated, and only the cooling material is changed to $Na_2CO_3 \cdot 10H_2O$. The coating amount of the cooling material is 4 g/m$^2$. Through comparative studies, it is found that when the cooling section designed in the present invention is used to replace a creased PLA film cooling section in an iQOS cigarette, the maximum temperature of smoke entering the mouth is 65° C., which is 4° C. higher than the temperature of iQOS smoke entering the mouth; meanwhile, the total particulate matter in the smoke is reduced to 7.5 mg/cig, which is 7.5 mg/cig lower than that of the iQOS smoke; the amount of smoke entering the mouth is obviously decreased, and the cooling and low smoke entrapping effects cannot be achieved (see Table 1).

Comparative Example 3

Embodiment 1 is repeated, and only the cooling material is changed to $CaCl_2 \cdot 4H_2O$. The coating amount of the cooling material is 4 g/m$^2$. Through comparative studies, it is found that when the cooling section designed in the present invention is used to replace a creased PLA film cooling section in an iQOS cigarette, the maximum temperature of smoke entering the mouth is 66° C., which is 5° C. higher than the temperature of iQOS smoke entering the mouth; meanwhile, the total particulate matter in the smoke is reduced to 7.6 mg/cig, which is 7.4 mg/cig lower than that of the iQOS smoke; the amount of smoke entering the mouth is obviously decreased, and the cooling and low smoke entrapping effects cannot be achieved (see Table 1).

Comparative Example 4

Embodiment 1 is repeated, and only the cooling material is changed to $Na_2SO_4 \cdot 10H_2O$. The coating amount of the cooling material is 4 g/m$^2$. Through comparative studies, it is found that when the cooling section designed in the present invention is used to replace a creased PLA film cooling section in an iQOS cigarette, the maximum temperature of smoke entering the mouth is 65° C., which is 4° C. higher than the temperature of iQOS smoke entering the mouth; meanwhile, the total particulate matter in the smoke is reduced to 7.3 mg/cig, which is 7.7 mg/cig lower than that of the iQOS smoke; the amount of smoke entering the mouth is obviously decreased, and the cooling and low smoke entrapping effects cannot be achieved (see Table 1).

TABLE 1

Maximum temperature of smoke entering the mouth, total particulate matter and amount of smoke of heat-not-burn cigarettes

| Sample | Maximum temperature of smoke entering the mouth (° C.) | Total particulate matter (mg/cig) | Amount of smoke |
|---|---|---|---|
| iQOS used as control | 61 | 15.0 | Large |
| Embodiment 1 | 60 | 12.0 | Relatively large |
| Embodiment 2 | 50 | 14.5 | Large |
| Embodiment 3 | 43 | 15.2 | Large |
| Embodiment 4 | 48 | 14.4 | Large |
| Embodiment 5 | 49 | 14.5 | Large |
| Embodiment 6 | 50 | 14.3 | Large |
| Embodiment 7 | 45 | 14.6 | Large |
| Embodiment 8 | 59 | 12.2 | Relatively large |
| Embodiment 9 | 51 | 14.5 | Large |
| Embodiment 10 | 53 | 14.2 | Large |
| Embodiment 11 | 41 | 15.3 | Large |
| Embodiment 12 | 45 | 15.1 | Large |
| Embodiment 13 | 46 | 14.8 | Large |
| Embodiment 14 | 40 | 15.1 | Large |
| Embodiment 15 | 45 | 14.7 | Large |
| Embodiment 16 | 44 | 15.2 | Large |
| Embodiment 17 | 37 | 15.8 | Large |
| Comparative Example 1 | 64 | 8.2 | Small |
| Comparative Example 2 | 65 | 7.5 | Small |
| Comparative Example 3 | 66 | 7.6 | Small |
| Comparative Example 4 | 65 | 7.3 | Small |

The contents illustrated by the above embodiments should be understood as these embodiments are merely used for illustrating the present invention more clearly, rather than limiting the scope of the present invention. Various equivalent modifications made to the present invention by those skilled in the art after reading the present invention all fall within the scope defined by the appended claims of the present application.

The invention claimed is:

1. A cooling cigarette filter, comprising a cooling section, wherein:

the cooling section is provided with one or more channels connecting two ends of the cooling section;

an inner surface of each channel is coated with a cooling material;

the cooling material is a compound mixture of an inorganic phase change material and PEG; and the inorganic phase change material comprises at least one of $Na_2CO_3 \cdot 10H_2O$, $CH_3COONa \cdot 3H_2O$, $CaCl_2 \cdot 4H_2O$, and $Na_2SO_4 \cdot 10H_2O$.

2. The cooling cigarette filter according to claim 1, wherein the PEG comprises at least one of PEG-200, PEG- 400, PEG-600, PEG-800, PEG-1000, PEG-1500, PEG-2000, PEG-4000, PEG-6000, PEG-8000, PEG-10000, and PEG-20000.

3. The cooling cigarette filter according to claim 1, wherein the PEG is at least one of PEG-200, PEG-400, PEG-600, PEG-800, PEG-1000, PEG-1500, PEG-2000, PEG-4000, PEG-6000, and PEG-8000.

4. The cooling cigarette filter according to claim 1, wherein a mass ratio of the inorganic phase change material to the PEG in the cooling material is (1-2):(1-5).

5. The cooling cigarette filter according to claim 1, wherein a coating amount of the cooling material is 3-50 $g/m^2$.

6. The cooling cigarette filter according to claim 5, wherein the coating amount of the cooling material is 5-30 $g/m^2$.

7. The cooling cigarette filter according to claim 1, wherein the channel is a through hole or an irregular hole.

8. The cooling cigarette filter according to claim 1, wherein:

the cooling section is formed by repeatedly bending or twisting a carrier in a cylindrical space;

the cooling material is coated on a surface of the carrier; and the carrier is one of paper, an organic polymer film, and a non-woven fabric.

9. The cooling cigarette filter according to claim 1, wherein the cooling section is formed by bundling a plurality of cylinders, and the cooling material is coated on inner surfaces and/or outer surfaces of the cylinders.

10. A smoking product, comprising:

a cooling cigarette filter and a smoke generation section connected with the cooling cigarette filter, wherein the cooling cigarette filter comprises a cooling section, wherein:

the cooling section is provided with one or more channels connecting two ends of the cooling section;

an inner surface of each channel is coated with a cooling material;

the cooling material is a compound mixture of an inorganic phase change material and PEG; and the inorganic phase change material comprises at least one of $Na_2CO_3 \cdot 10H_2O$, $CH_3COONa \cdot 3H_2O$, $CaCl_2 \cdot 4H_2O$, and $Na_2SO_4 \cdot 10H_2O$.

11. The smoking product according to claim 10, wherein the PEG comprises at least one of PEG-200, PEG-400, PEG-600, PEG-800, PEG-1000, PEG-1500, PEG-2000, PEG-4000, PEG-6000, PEG-8000, PEG-10000, and PEG-20000.

12. The smoking product according to claim 10, wherein the PEG is at least one of PEG-200, PEG-400, PEG-600, PEG-800, PEG-1000, PEG-1500, PEG-2000, PEG-4000, PEG-6000, and PEG-8000.

13. The smoking product according to claim 10, wherein a mass ratio of the inorganic phase change material to the PEG in the cooling material is (1-2):(1-5).

14. The smoking product according to claim 10, wherein a coating amount of the cooling material is 3-50 $g/m^2$.

15. The smoking product according to claim 14, wherein the coating amount of the cooling material is 5-30 $g/m^2$.

16. The smoking product according to claim 10, wherein the channel is a through hole or an irregular hole.

17. The smoking product according to claim 10, wherein:

the cooling section is formed by repeatedly bending or twisting a carrier in a cylindrical space;

the cooling material is coated on a surface of the carrier; and the carrier is one of paper, an organic polymer film, and a non-woven fabric.

18. The smoking product according to claim 10, wherein the cooling section is formed by bundling a plurality of cylinders, and the cooling material is coated on inner surfaces and/or outer surfaces of the cylinders.

* * * * *